US010837271B2

(12) United States Patent
Qu

(10) Patent No.: US 10,837,271 B2
(45) Date of Patent: Nov. 17, 2020

(54) METHOD AND DEVICE FOR CONDUCTING EXPLOSIVE-FRACTURING

(71) Applicant: Bo Qu, Vaughan (CA)

(72) Inventor: Bo Qu, Vaughan (CA)

( * ) Notice: Subject to any disclaimer, the term of this patent is extended or adjusted under 35 U.S.C. 154(b) by 34 days.

(21) Appl. No.: 16/382,048

(22) Filed: Apr. 11, 2019

(65) Prior Publication Data

US 2019/0368329 A1 Dec. 5, 2019

Related U.S. Application Data

(60) Provisional application No. 62/677,308, filed on May 29, 2018.

(51) Int. Cl.
*E21B 43/263* (2006.01)
*E21B 34/10* (2006.01)

(52) U.S. Cl.
CPC ..... *E21B 43/263* (2013.01); *E21B 34/10* (2013.01)

(58) Field of Classification Search
CPC ..... E21B 43/11; E21B 43/26; E21B 43/114; E21B 43/263; E21B 43/243; E21B 43/247; E21B 43/248
See application file for complete search history.

(56) References Cited

U.S. PATENT DOCUMENTS 3,075,463 A * 1/1963 Eilers ..... C06B 47/00 166/299
3,174,545 A * 3/1965 Mohaupt ..... F42B 3/00 166/299
3,422,760 A * 1/1969 Mohaupt ..... E21B 43/263 102/313
5,111,746 A * 5/1992 Pentel ..... F42B 12/16 102/308
6,053,247 A * 4/2000 Wesson ..... E21B 29/02 166/297
2005/0109509 A1* 5/2005 Snider ..... E21B 43/263 166/297
2019/0316455 A1* 10/2019 Surjaatmadja ..... F42D 1/05

* cited by examiner

*Primary Examiner* — Kenneth L Thompson
(74) *Attorney, Agent, or Firm* — Novick, Kim & Lee, PLLC; Allen Xue

(57) ABSTRACT

A downhole sub for injecting and detonating liquid explosive into a subterranean formation has a first fluid chamber, a second fluid chamber, a piston slidably disposed between and separates the first fluid chamber and the second fluid chamber, and a detonation unit affixed to the piston. It also has a third fluid chamber, a coupling disposed between the second fluid chamber and the third fluid chamber, and an annular sealing device disposed about the downhole sub. During operation, the downhole sub is filled with a liquid explosive and lowered into a well. A hydraulic fluid is injected into the downhole sub to initiate a process in which a portion of the well casing having a plurality of perforations in its wall is isolated from the rest of the well first, the liquid explosive is then injected into the isolated portion, and from there into the surrounding subterranean formation, and finally ignited to create fractures in the formation.

14 Claims, 7 Drawing Sheets

B

C

METHOD AND DEVICE FOR CONDUCTING EXPLOSIVE-FRACTURING

FIELD OF TECHNOLOGY

This disclosure relates to methods and devices for oil and gas well completion, more particularly relates to methods and devices for injecting and detonating liquid explosives for formation fracturing.

BACKGROUND

Hydraulic fracturing is an important technique in oil and gas well completion for high-density, low-permeability conventional reservoirs, as well as for unconventional shale reservoirs. However, the cost of hydraulic fracturing may account for more than one half of the total oil and gas well completion expenses. In addition, conventional hydraulic fracturing consumes a large volume of water, causing environmental issues and social controversy. Also, accessing oil and gas fields located in complex terrains is very challenging. In-layer explosive fracturing technology provides an alternative to hydraulic fracturing. However, explosive fracturing requires more precise control to ensure safety and effectiveness. The current disclosure provides methods and devices that meet such needs, in particular, injecting and detonating liquid explosive in underground reservoirs.

SUMMARY

The current disclosure provides a downhole sub for injecting and detonating liquid explosive into a subterranean formation. The downhole sub includes a cylindrical body and an annual sealing device disposed about the cylindrical body. The cylindrical body includes a first fluid chamber, a second fluid chamber, a third fluid chamber, a piston slidably disposed between and separating the first fluid chamber and the second fluid chamber, and a detonation unit affixed to the piston. The cylindrical body further includes a coupling disposed between the second fluid chamber and the third fluid chamber.

In one embodiment, the annular sealing device include a first annular sealing ring, an annular support sleeve, a second annular sealing ring arranged in tandem in the axial direction of the cylindrical body.

In another embodiments, the first fluid chamber and the third fluid chamber each stores a same hydraulic fluid or different hydraulic fluids, while the second fluid chamber stores a liquid explosive.

In some embodiments, the detonation unit comprises a detonation charge, a percussion detonator and a firing pin. In other embodiments, the coupling comprises one or more first fluid channels that connect the second fluid chamber and the third fluid chamber and one or more second fluid channels that align with one or more liquid injection holes in a wall of the support sleeve. The coupling houses a spring-loaded check valve having an inlet connected to the second fluid chamber and an outlet connected to the one or more second fluid channels in the coupling.

In a further embodiment, the downhole sub includes a first annular piston in contact with the first annular sealing ring and a second annular piston in contact with the second annular sealing ring. In addition, a third fluid channel is disposed between the second fluid chamber and the first annular piston so that the liquid explosive in the second fluid chamber is in contact with the first annular piston. A fourth fluid channel is disposed between the third fluid chamber and the second annular piston so that the hydraulic fluid in the third fluid chamber is in contact with the second annular piston.

During operation, the piston exerts a pressure on the liquid explosive in the second fluid chamber, and the pressurized liquid explosive pushes open the spring-loaded check valve so as to form a fluid passage through the spring-loaded check valve, the one or more second fluid channels in the coupling, and one or more liquid injection holes in the wall of the support sleeve.

Further, during operation, the piston exerts a pressure on the liquid explosive in the second fluid chamber, and the pressurized liquid explosive pushes first annular piston toward the first annular sealing ring.

Still, during operation, the pressurized liquid explosive enters the third fluid chamber through the one or more first fluid channels in the coupling so as to pressurize the hydraulic fluid in the third fluid chamber. The pressurized hydraulic fluid pushes the second annular piston toward the second annular sealing ring.

The first annular sealing ring is expandable in a radial direction of the downhole sub when pushed by the first annular piston against the support sleeve and the second annular sealing ring is expandable in the radial direction of the downhole sub when pushed by the second annular piston against the support sleeve.

This disclosure further provides a method for injecting and detonating a liquid explosive in a subterranean formation using a downhole sub of this disclosure. The method includes filling the downhole sub with a liquid explosive and hydraulic fluid, lowering it to a target section of the well, injecting a hydraulic fluid into the first fluid chamber so as to pressurize the liquid explosive in the second fluid chamber.

When the pressure of the liquid explosive is lower than a pre-determined value, the spring-loaded check valve remains closed so that the liquid explosive does not enter the one or more second fluid channels, and the pressurized liquid explosive causes compression in the first annular sealing ring and the second annular sealing ring along an axial direction of the downhole sub so that the first annular sealing ring and the second annular sealing ring expand in a radial direction of the downhole sub against a well casing surrounding the downhole sub until the portion of the well casing between the first annular sealing ring and the second annular sealing ring is isolated from the other portions of the well casing.

When the pressure of the liquid explosive is higher than the pre-determined value, the spring-loaded check valve opens so that the liquid explosive enters the isolated portion of the well and from there into the subterranean formation through a plurality of perforation holes on the well casing.

When the liquid explosive is released from the second fluid chamber, the detonation unit causes the liquid explosive to explode, creating fractures in the subterranean formation.

BRIEF DESCRIPTIONS OF THE DRAWINGS

These and other features, aspects, and advantages of the present invention will become better understood by reference to the accompanying drawings.

Figure 1:
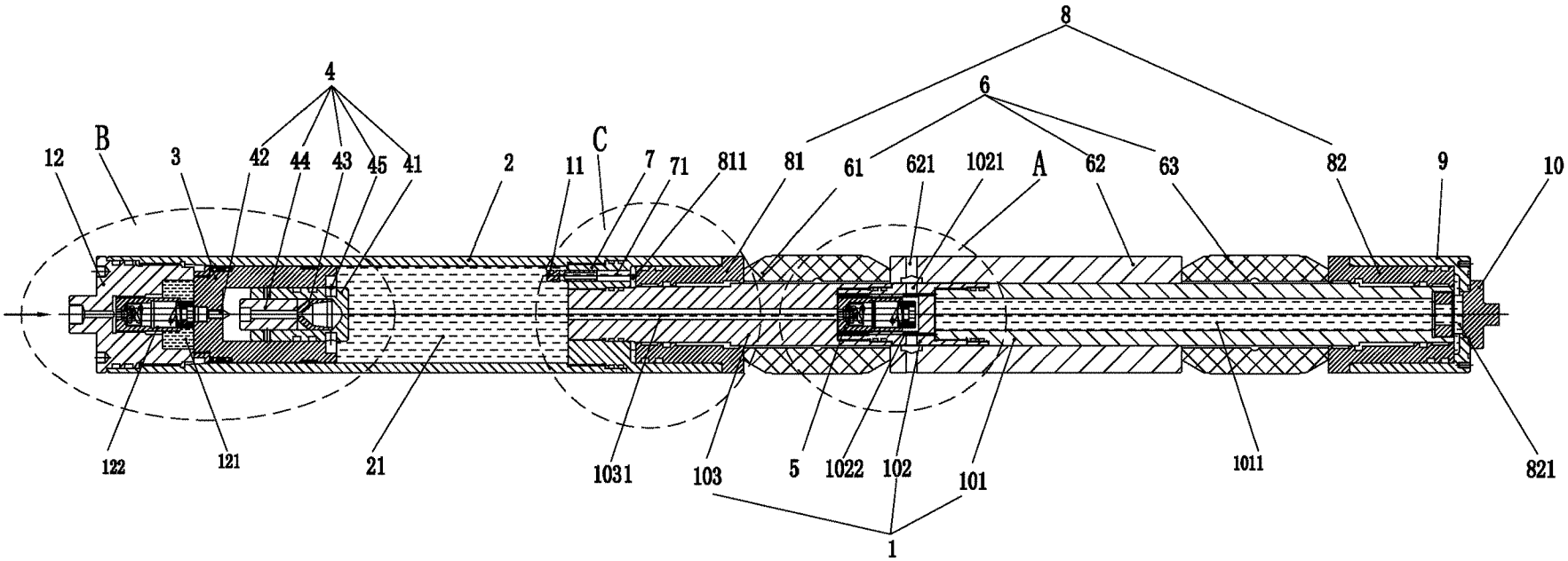
FIG. 1 is shows an embodiment of the liquid injection and detonation downhole sub in the current disclosure.
Figure 6:
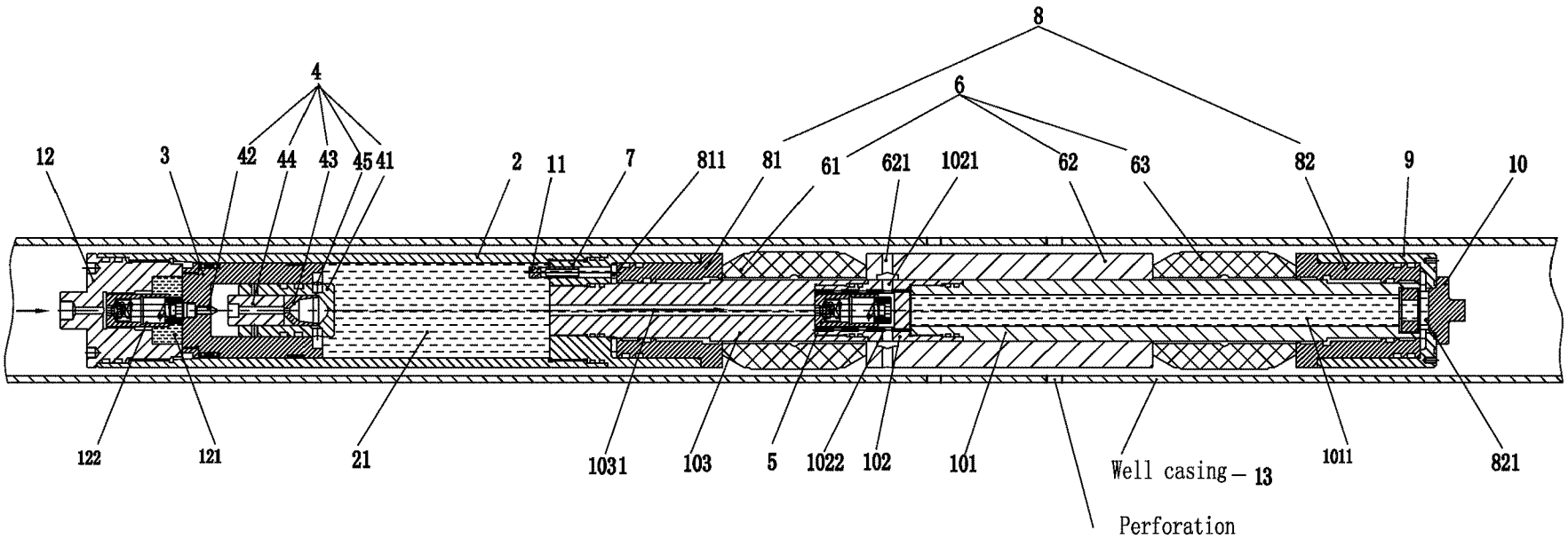
Figure 7:
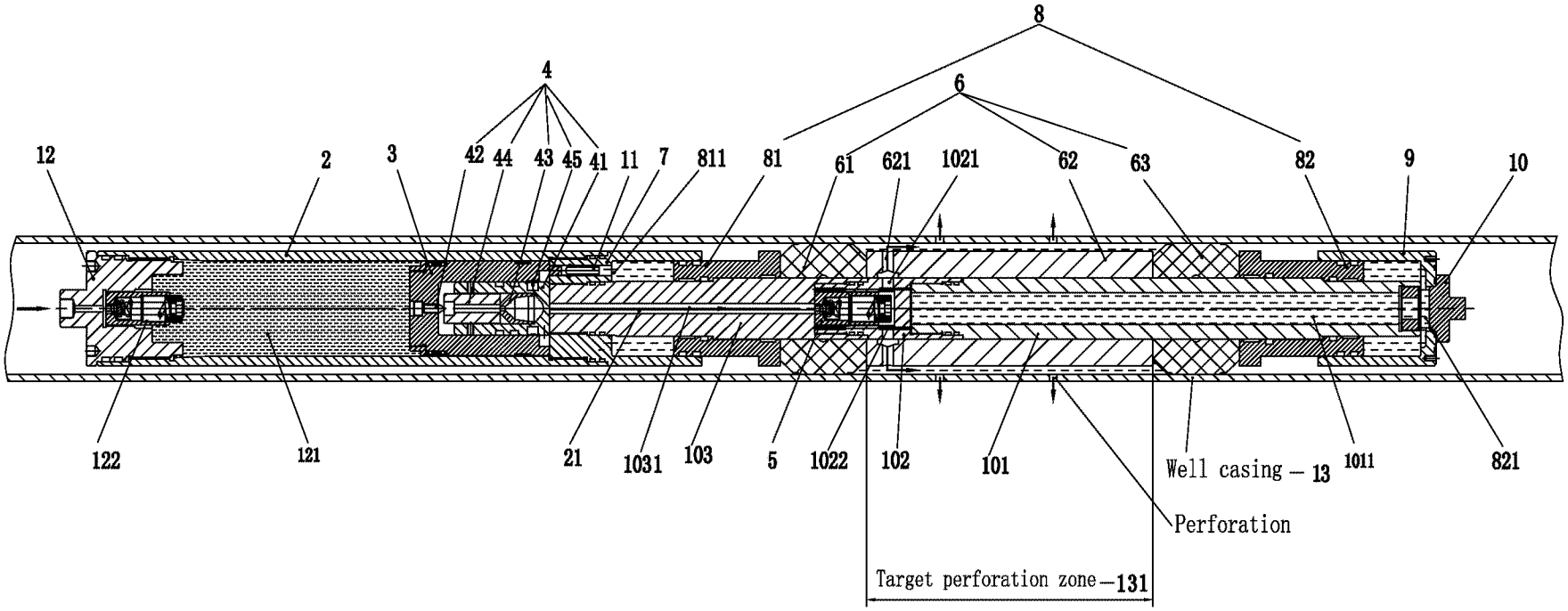

FIG. 6 presents the downhole sub of FIG. 1 filled with a liquid explosive in a well casing;

FIG. 7 presents the downhole sub of FIG. 1 after most of the liquid explosive has been injected into the formation.

Table A below lists various components and reference numerals thereof.

TABLE A

| | |
|---|---|
| Center cylinder assembly 1 | Outer tube 2 |
| Piston 3 | First fluid chamber 121 |
| Second Fluid chamber 21 | First cylinder 101 |
| Coupling 102 | Second cylinder 103 |
| Flow switch 11 | Top connector 12 |
| Check valve 122 | Center channel 1031 |
| First channel 1022 | Fluid injection channel 1021 |
| Third fluid chamber 1011 | Wall 1024 |
| Gap 1023b | Gap 1023a |
| Detonation unit 4 | Cylindrical body 41 |
| Firing pin 42 | Detonation charge 43 |
| Percussion detonator 44 | Shear pins 45 |
| Pressure control module 5 | Housing 51 |
| Ball seat 52 | Ball 53 |
| Pressure spring 54 | Pressure adjusting nut 55 |
| Isolation unit 6 | First elastic sealing ring 61 |
| Support sleeve 62 | Fluid outlet 621 |
| Second elastic sealing ring 63 | Annular coupling 7 |
| Second channel 71 | Axial compression assembly 8 |
| First annular piston 81 | Second annular piston 82 |
| First Gap 811 | Second Gap 821 |
| Guiding head 9 | Compression bolt 10 |
| Well casing 13 | Perforations 131 |

DETAILED DESCRIPTION OF EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/". It should be understood that the "left" and "right" mentioned below are based on the instructions shown in the respective figures. The words used for directions are merely for convenience of explanation and do not represent limitations of the technicalities of the invention.

As shown in FIG. 1, the fluid injection and denotation downhole sub has a center cylinder assembly 1, an outer tube 2, a piston 3, a detonation unit 4, a pressure control module 5, an isolation unit 6, an annular coupling 7, an axial compression assembly 8, and a guiding head 9. The top connector 12 is at the proximal end of the downhole sub that is closer to the surface. The distal end of the device, which is further from the surface, has the compression bolt 10. In this disclosure the proximal end of a component in the device is from time to time referred to as "left end" while the distal end of the component is referred to as the "right end," which are their positions shown in the respective figures.

The center cylinder assembly 1 and the outer tube 2 are connected at the annular coupling 7. The distal end of the outer tube 2 sleeves over the proximal end of the annular coupling 7 while the distal portion of the annular coupling 7 sleeves over the first annular piston 81. While the proximal end of the center cylinder assembly 1 extends through the length of the annular coupling 7.

Figure 4:
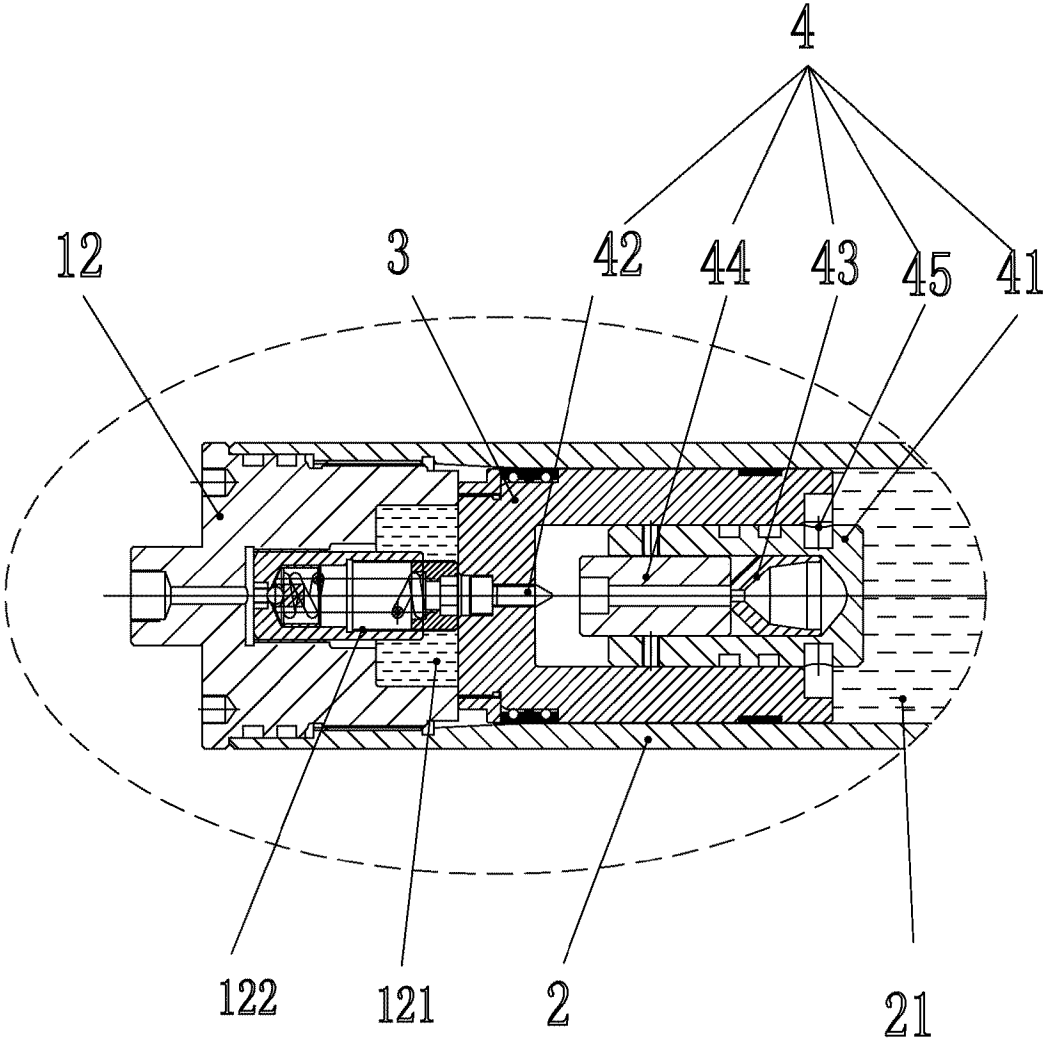
FIG. 4 shows the enlarged section B in the downhole sub of FIG. 1.
Figure 5:
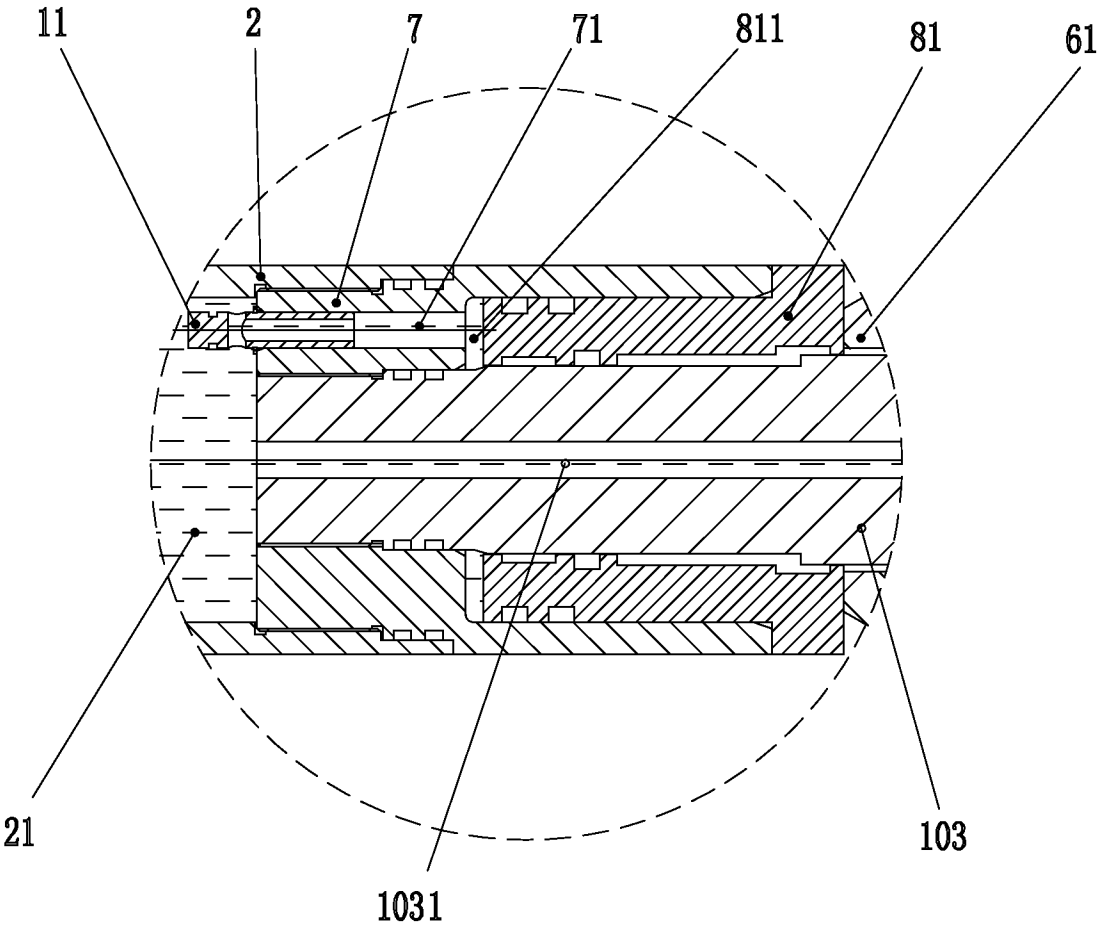
FIG. 5 shows the enlarged section C in the downhole sub of FIG. 1.

Referring to FIGS. 1 and 4, the piston 3 and the detonation unit 4 are disposed about the proximal end of the downhole sub. Specifically, the piston 3 is movably disposed in the outer tube 2. In this embodiment, the detonation unit is affixed to the piston 3 by a pair of shear pins 45. The distal end of the detonation unit 4 extends out from the distal end of the piston 3. The firing pin is disposed to the proximal end of the detonation unit while the detonation charge 43 is to the distal end. The detonator 44 is connected to the detonation charge 43, disposed away from the firing pin 42. During operation, when the distal end of the cylindrical body 41 is pushed against the second cylinder 103, the shear pins 45 can be severed, allowing the detonator 44 to be pushed toward the firing pin 42. Collision between the firing pin 42 and the detonator 44 ignites the detonation charge 43.

Figure 3:
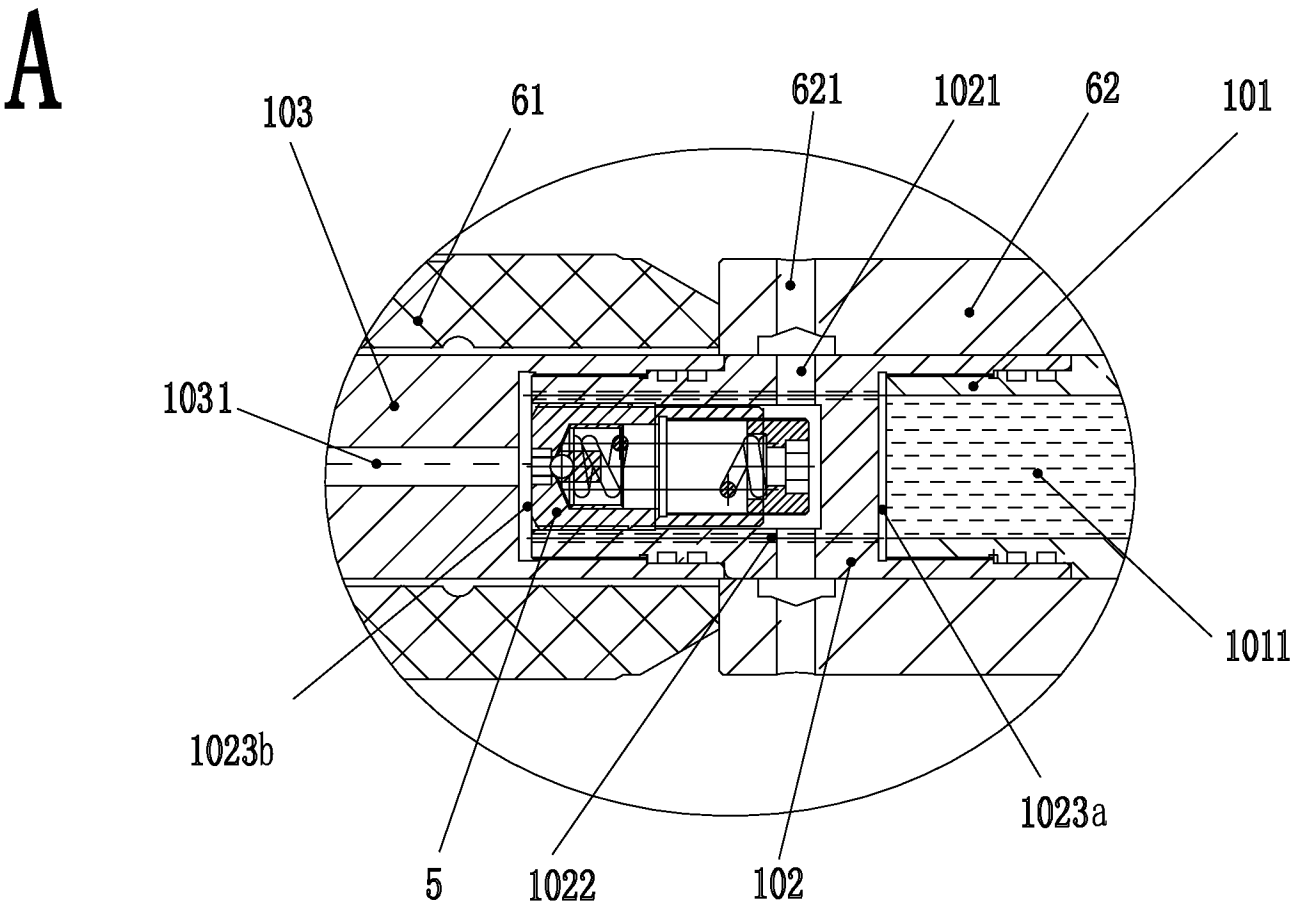
FIG. 3 shows the enlarged section A in the downhole sub in FIG. 1.

Referring to FIG. 1 and FIG. 3, the center cylinder assembly 1 includes the first cylinder 101, the second cylinder 103, and the coupling 102 disposed between the first cylinder 101 and the second cylinder 103. The isolation unit 6 is disposed about the center cylinder assembly 1. It consists of a first elastic sealing ring 61, a support sleeve 62, and a second elastic sealing ring right 63. The axial compression assembly 8 has a first annular piston 81 abutting the first elastic sealing ring 61 and a second annular piston 82 abutting the second elastic sealing ring 63. The support sleeve 62 is disposed between the two elastic sealing rings 61 and 63. The center cylinder assembly 1 further includes a guiding head 9 affixed to its distal end by a compression bolt 10.

Figure 2:
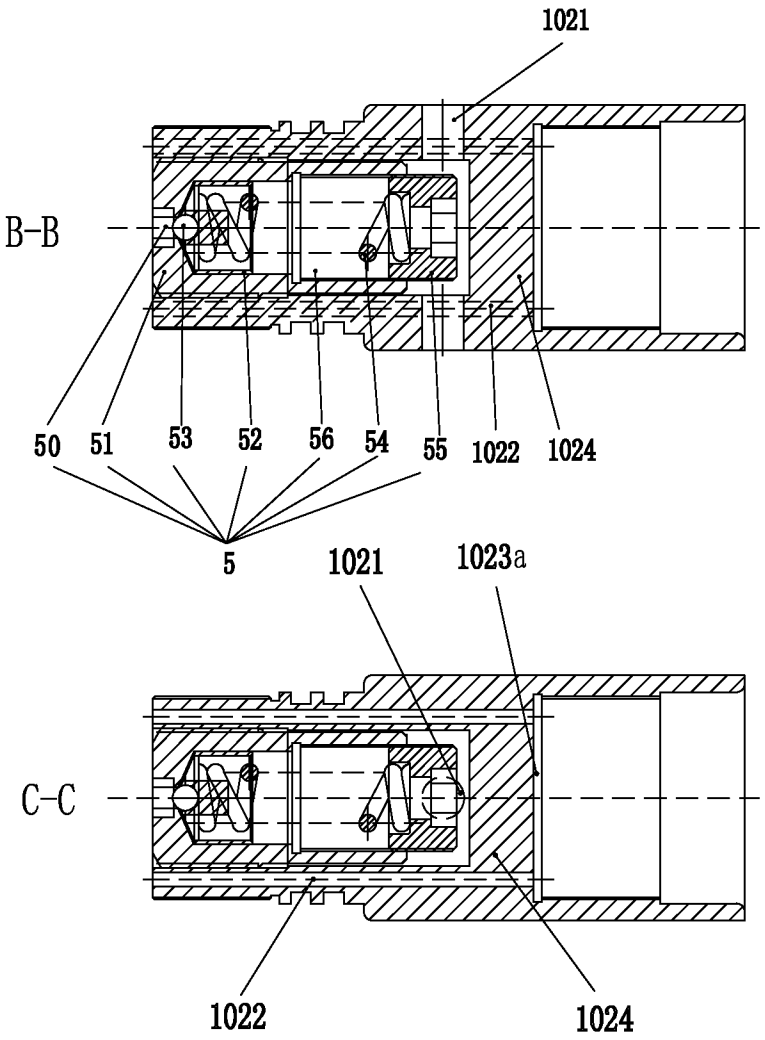
FIG. 2 shows an embodiment of the pressure control module of the downhole sub in FIG. 1.
Figure 2:
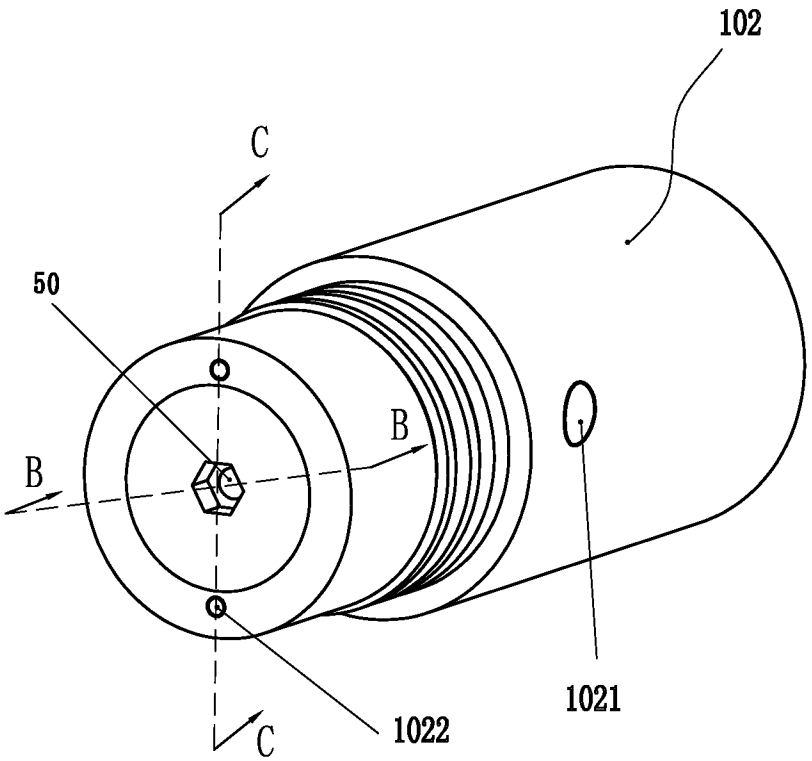

FIG. 2 shows three views of the assembly having the coupling 102 and the pressure control module 5, which are respectively the perspective view, the sectional view along the B-B direction, and the sectional view of the C-C direction. The coupling 102 is separated into a first tubular portion on the left and a second tubular portion on the right by a wall 1024. In this embodiment the pressure control module 5, which has a spring-loaded check valve, resides in the first tubular portion. The pressure control module 5 has a housing 51 with an internal space 56, a ball seat 52, a pressure ball 53, a pressure spring 54, and a pressure adjustment nut 55. The ball seat 52 is disposed inside the housing 51 on the left side while the pressure adjustment nut 55 is disposed inside the housing 51 on the right side. The pressure ball 53 is placed at the left end of ball seat 52 and abuts tightly against the inlet 50 to the housing. The pressure spring 54 is placed between the ball seat 52 and the pressure adjustment nut 55. The pressure control module 5 is normally in a closed position since the pressure ball 53 blocks the inlet 50. When the pressure exerted on the spring 54 exceeds a certain preset value, the pressure ball 53 and spring 54 are compressed, opening the inlet 50. The pressure adjustment nut 55 adjusts the tension in the spring 54, effectively setting the pressure at which the inlet is open or closed.

The fluid injection channel 1021 penetrates the wall of the first tubular section of the coupling 102 in the radial direction. There are also a pair of first channels 1022 extending through the wall 1024 of the first tubular section of the coupling 102 in axial direction and open into the second tubular portion.

As shown in FIG. 3, the second tubular portion receives a section at the proximal end of the first cylinder 101. The hollow center of the first cylinder 101 serves as the third fluid chamber 1011. The space between the wall 1024 in the coupling 102 and the proximal end of the first cylinder 101 is the gap 1023*a*. The space between the left end of the coupling 102 and the second cylinder 103 is the gap 1023*b*. Note that first channels 1022 connect the gap 1023*a* with the gap 1023*b*. The fluid injection channel 1021 and first channel 1022 are not connected, i.e., channel 1021 and first channel 1022 are dislocation channels. The presence of 1023*a* and 1023*b* prevent the first channels 1022 from being blocked. Further, fluid outlet 621 are two fluid channels in the support sleeve 62, which are aligned with fluid injection channels 1021.

FIG. 6 shows the downhole sub filled with the liquid explosive. The second fluid chamber 21 is the space surrounded by the outer tube 2, the piston 3, the proximal end of the second cylinder 103, and the proximal end of the annular coupling 7. During operation, the second fluid chamber 21 is first filled with a liquid explosive. The third fluid chamber 1011, which is the hollow center of the first cylinder 101, is filled with a hydraulic fluid. Once filled, the downhole sub is lowered into the well to a pre-determined zone.

During operation, the top connector 12 connects with a driving unit (not shown). The space formed by top connector 12, the outer tube 2, and the piston 3 is the first fluid chamber 121, which stores the hydraulic fluid injected by the driving unit through a check valve 122 in the top connector 12. After the downhole sub is lowered to the desired location in the well, the hydraulic fluid from the driving unit is injected into the first fluid chamber 121, thereby pushing the piston 3 to the right, which in turn pushes the liquid explosive in the second fluid chamber 21 through the flow switch 11 and the second channel 71 into the first gap 811. The pressure exerted by the liquid explosive on the first annular piston 81 pushes it to the right.

At the same time, the liquid explosive in second fluid chamber 21 also flows through the center channel 1031 in second cylinder 103, the first channels 1022, into the gap 1023*a*, and from there into the third fluid chamber 1011. The volume of liquid in the third fluid chamber 1011 therefore expands, elevating the pressure of the hydraulic fluid therein. As a result, the hydraulic fluid flows from third fluid chamber 1011 through the second gap 821 and pushes the second annular piston 82 to the left. Consequently, the first annular piston 81 and the second annular piston 82 push the first elastic sealing ring 61 and the second elastic sealing ring 63, respectively, toward the support sleeve 62. The first elastic sealing ring 61 and the second elastic sealing ring 63 are compressed axially and expand radially against the well casing 13. Expansion of the elastic sealing rings 61 and 63 eventually isolates the section of the well between them from the rest portion of the well. The section of well casing 13 between the two elastic sealing rings 61 and 63 contains a plurality of perforations and is referred to as the perforation zone 131 on the well casing 13.

Note that isolation of the perforation zone 131 occurs when injection of hydraulic fluid gradually pressurizes the hydraulic fluid as well as the liquid explosive in the downhole sub. However, before the pressure of the liquid explosive exceeds the pressure of the pressure control module 5, even if the elastic sealing rings 61 and 63 start expanding in the radial direction, the pressure control module 5 remains closed so that no liquid explosive enters the perforation zone.

In another aspect, the deformation of the elastic sealing rings 61 and 63 gradually increases resistance and elevates the pressure of the liquid explosive in the second fluid chamber 21. Referring again to FIGS. 3 and 7, the liquid explosive in the center channel 1031 exerts pressure against the pressure ball 53. When the pressure is greater than the pressure set by the pressure spring 54 in the pressure control module 5, the liquid explosive pushes the pressure ball 53 away from the inlet 50, fills the internal chamber 56, and exits from the outlet in the pressure adjustment nut 55 into the fluid injection channels 1021 and fluid outlets 621. The liquid explosive then enters the sealed zone around the perforation zone 131 and through the plurality of perforations in the well casing into the subterranean formation. In this manner, the liquid explosive in the second fluid chamber 21 is injected into the subterranean formation.

Referring to FIG. 7, after the liquid explosive in second fluid chamber 21 is released into the downhole subterranean formation, the distal end of the piston 3 presses against flow switch 11. The flow switch 11 moves into second channel 71. Thus, the liquid explosive between flow switch 11 and first annular piston 81 are completely separated from the liquid explosive in second fluid chamber 21.

When the flow switch 11 moves into second channel 71, the detonation unit 4, carried by piston 3, is pushed against the proximal end of second cylinder 103. This movement severs the shear pins 45 that restrain the cylindrical body 41. Consequently, the cylindrical body 41 (carrying detonation charge 43) moves to the left together with piston 3 until the percussion detonator 44 collides with the firing pin 42. The percussion detonator 44 ignites the detonation charge 43. The detonation produces a high-speed jet that penetrates the wall at right end of cylindrical body 41, further igniting the liquid explosive in the center channel 1031 of second cylinder 103. The remaining liquid explosive in the liquid injection channels and the perforation zone in the downhole sub acts as a detonation transmitter, ignites the liquid explosive in the subterranean formation, thereby causing a series of controlled explosions and fracturing in the subterranean formation surrounding the well.

In one preferred embodiment of the disclosed device and the method, the perforation zone 131 is isolated by the elastic sealing rings 61 and 63 prior to being filled with liquid explosive so that the liquid explosive is injected into the formation at the desired zone. Further, the denotation unit ignites when the liquid explosive is driven out from the second fluid chamber. In this aspect, a certain amount of the liquid explosive enters the third fluid chamber to compensate for the hydraulic liquid utilized for isolating the perforation zone.

Explosive fracturing in hydrocarbon reservoir layers is a dynamic process. Under the shock load effects at certain loading speed, a network of fractures is formed in the formation, which greatly increases the volumetric fracture density of the reservoir. The explosion shock wave, the stress wave, and the large amount of high-pressure gas generated by the explosion cause the fractures to further expand and extend. In the meantime, the formation layer is torn, staggered, and twisted and having the support of gravels, the fractures will not be able to resume in-situ closure after the shock-load is discharged. This create fractures with higher permeability. At the same time, the reservoir will experience irreversible plastic deformation under the high pressure exceeding its yield strength limit. As such, the fractures will maintain a certain slit width after the shock wave pressure is discharged.

As shown in Table B, the preliminary test using the downhole sub of FIG. 1 shows that liquid explosive fracturing is evidently more efficient than hydraulic fracturing. Liquid explosive fracturing can greatly increase the drainage area of in the formation and enhance the communication between the wellbore and the formation. This significantly increases the oil and gas reservoir recovery rate and the production of a well.

TABLE B

| Item | Performance | Performance of this invention compared to traditional hydraulic fracturing (under the same hydrocarbon reservoir conditions) |
|---|---|---|
| 1 | Production | Increased 2-8 times |
| 2 | Recovery Rate | Increased 1-3 times |
| 3 | Water Consumption | Reduced by approximately 99% |
| 4 | Proppant (Sand) Consumption | This method does not require proppant |
| 5 | Cost of Reservoir Stimulation | Reduced by approximately 50% |
| 6 | Equipment Requirements | Does not require large-scaled equipment for operation |
| 7 | Geographical Conditions | The device of this invention is 1-10 tons (2,200-22,000 lb.) It is small in size and convenient for transportation in any geographical environments. |

The above embodiments illustrate some of the applications of the present disclosure. Additional embodiments and variations thereof are numerous. For example, the device can be modified by removing the detonation unit or removing the detonation charge from the detonation unit. After such modification, the device can be deployed to inject any solid-free fluid, e.g., completion fluid, into a formation at a certain zone in the well. The device and method of this disclosure can be applied to both vertical well and directional well.

We claim:

1. A downhole sub for injecting and detonating liquid explosive in a subterranean formation, comprising: a cylindrical body and an annular sealing device disposed about the cylindrical body, wherein the cylindrical body comprises a first fluid chamber, a second fluid chamber, a third fluid chamber, a piston slidably disposed between the first fluid chamber and the second fluid chamber, a detonation unit affixed to the piston, and a coupling disposed between the second fluid chamber and the third fluid chamber; and wherein the annular sealing device comprises a first annular sealing ring, an annular support sleeve, and a second annular sealing ring arranged in tandem along an axial direction of the cylindrical body, wherein the first fluid chamber and the third fluid chamber each stores a same hydraulic fluid or different hydraulic fluids, and a second fluid chamber stores a liquid explosive, wherein the detonation unit comprises a detonation charge and a firing pin, wherein the coupling comprises one or more first fluid channels that connect the second fluid chamber and the third fluid chamber and one or more second fluid channels that align with one or more liquid injection holes in a wall of the support sleeve, and wherein the coupling further houses a spring-loaded check valve having an inlet connected to the second fluid chamber and an outlet connected to the one or more second fluid channels in the coupling.

2. The downhole sub of claim 1, wherein the annular sealing device further comprises a first annular piston in contact with the first annular sealing ring and a second annular piston in contact with the second annular sealing ring.

3. The downhole sub of claim 2, wherein a third fluid channel is disposed between the second fluid chamber and the first annular piston so that the liquid explosive in the second fluid chamber is in contact with the first annular piston, and wherein a fourth fluid channel disposed between the third fluid chamber and the second annular piston so that the hydraulic fluid in the third fluid chamber is in contact with the second annular piston.

4. The downhole sub of claim 1, wherein, during operation, the piston exerts a pressure on the liquid explosive in the second fluid chamber, and the pressurized liquid explosive pushes open the spring-loaded check valve so as to form a fluid passage through the spring-loaded check valve, the one or more second fluid channels in the coupling, and one or more liquid injection holes in the wall of the support sleeve.

5. The downhole sub of claim 3, wherein, during operation, the piston exerts a pressure on the liquid explosive in the second fluid chamber, and the pressurized liquid explosive pushes first annular piston toward the first annular sealing ring.

6. The downhole sub of claim 4, wherein the pressurized liquid explosives enters the third fluid chamber through the one or more first fluid channels in the coupling so as to pressurize the hydraulic fluid in the third fluid chamber, the pressurized hydraulic fluid pushes the second annular piston toward the second annular sealing ring.

7. The downhole sub of claim 1, wherein the first annular sealing ring is expandable in a radial direction of the downhole sub when pushed by the first annular piston against the support sleeve and the second annular sealing ring is expandable in the radial direction of the downhole sub when pushed by the second annular piston against the support sleeve.

8. A method for injecting and detonating a liquid explosive in a subterranean formation, comprising:

lowering a downhole sub of claim 1 into a well in the subterranean formation;

injecting a hydraulic fluid into the first fluid chamber so as to pressurize the liquid explosive in the second fluid chamber.

9. The method of claim 8, when the pressure of the liquid explosive is lower than a pre-determined value, the spring-loaded check valve remains closed so that the liquid explosive does not enter the one or more second fluid channels, and the pressurized liquid explosive causes the first annular sealing ring and the second annular sealing ring to compress along an axial direction of the downhole sub and to expand in a radial direction of the downhole sub against a well casing surrounding the downhole sub until the portion of the well zone between the first annular sealing ring and the second annular sealing ring is isolated from other parts of the well.

10. The method of claim 9, when the pressure of the liquid explosive is higher than the pre-determined value, the spring-loaded check valve opens so that the liquid explosive enters the isolated portion of the well and into the subterranean formation through a plurality of perforations on the well casing.

11. The method of claim 10, when the liquid explosive is released from the second fluid chamber, the detonation unit causes the liquid explosive to ignite and to create fractures in the subterranean formation.

12. The method of claim 8, wherein the downhole sub further comprises a first annular piston in contact with the first annular sealing ring, a third fluid channel connects the second fluid chamber and the first annular piston so that the pressurized liquid explosive in the second fluid chamber pushes the first annular piston to compress the first annular sealing ring.

13. The method of claim 8, wherein the downhole sub further comprises a second annular piston in contact with the second annular sealing ring, and a second annular piston in contact with the second annular sealing ring, and a fourth fluid channel connects the second annular piston so that the hydraulic fluid in the third fluid chamber is in contact with the second annular piston, wherein the pressurized liquid explosives enters the third fluid chamber through the one or more first fluid channels in the coupling so as to pressurize the hydraulic fluid in the third fluid chamber, the pressurized hydraulic fluid pushes the second annular piston to compress the second annular sealing ring.

14. The method of claim 11, wherein, after the liquid explosive being driven out from the second fluid chamber, the detonation unit collides with a distal end of the second fluid chamber to ignite the detonation charger in the detonation unit.

* * * * *